US005094289A

United States Patent [19]

Gentry

[11] Patent Number: 5,094,289

[45] Date of Patent: Mar. 10, 1992

[54] ROASTED CARBON MOLDING (FOUNDRY) SAND AND METHOD OF CASTING

[75] Inventor: Everett G. Gentry, Palm Springs, Calif.

[73] Assignee: American Colloid Company, Arlington Heights, Ill.

[21] Appl. No.: 585,298

[22] Filed: Sep. 19, 1990

[51] Int. Cl.[5] ..... B22C 1/00; B22C 3/00; B22C 9/00

[52] U.S. Cl. ..... 164/529; 106/38.22; 106/38.28; 106/38.9; 164/33; 427/134

[58] Field of Search ..... 164/33, 529; 106/38.22, 106/38.28, 38.9; 427/134

[56] References Cited

U.S. PATENT DOCUMENTS

| | | | |
|---|---|---|---|
| 2,830,342 | 4/1958 | Meyers et al. | 106/38.9 X |
| 2,830,913 | 4/1958 | Meyers et al. | 164/529 X |
| 3,802,902 | 4/1974 | Turner, Jr. et al. | 106/38.22 X |

FOREIGN PATENT DOCUMENTS

| | | | |
|---|---|---|---|
| 0111616 | 6/1984 | European Pat. Off. | 164/529 |
| 1-233041 | 9/1989 | Japan | 164/529 |

*Primary Examiner*—J. Reed Batten, Jr.
*Attorney, Agent, or Firm*—Marshall, O'Toole, Gerstein, Murray & Bicknell

[57] ABSTRACT

A new and improved carbon sand and a method of treating a petroleum fluid coke, having a spherical or ovoid particle shape and a size suitable for a core or mold surface in the foundry industry, by heating or roasting the carbon particles at a temperature in the range of about 1000° F. to about 1500° F., particularly about 1200° F. to about 1400° F., for a time sufficient to volatilize from the carbon particles substantially all of the organic contaminants volatilizable at the roasting temperature, and a method of casting molten metal against the heat treated carbon particles, combined with a suitable binder, to form cast metal parts. The carbon sand also is useful in forming shell molds and shell cores and otherwise using the carbon sand to replace other molding and coremaking sands used in any of the various molding and coremaking processes with any of the various binder systems practiced by the foundry industry.

22 Claims, No Drawings

ROASTED CARBON MOLDING (FOUNDRY) SAND AND METHOD OF CASTING

FIELD OF THE INVENTION

The present invention is directed to a new and improved carbon foundry sand to replace sand in molds and cores, either partially or entirely, in the metal casting industry. More particularly, the present invention is directed to a roasted carbon-based molding sand for use in casting or molding ferrous and non-ferrous metal objects that is formed by heating spherical and/or ovoid carbon or coke particles at a temperature of about 1500° F. or less to remove volatile compounds, and thereby thermally stabilize the carbon sand for use in forming green, dried and/or baked molds, green and baked cores, mold facings, shell molds and cores, gas-cured, heat-cured and chemically-cured cores and molds, and the like. The resulting roasted carbon sand is particularly useful for casting non-ferrous metals, such as aluminum and copper metals, and alloys such as bronze, brass and the like, and is useful in casting iron and iron-containing alloys.

BACKGROUND OF THE INVENTION AND PRIOR ART

Relatively inexpensive silica sand grains bound together with a suitable binder is used extensively as a mold and core material for receiving molten metal in the casting of metal parts. Olivine sand is much more expensive than silica sand but provides cast metal parts of higher quality, particularly having a more defect-free surface finish, requiring less manpower after casting to provide a consumer-acceptable surface finish. Olivine sand, therefore, has been used extensively as a mold and core surface in casting non-ferrous parts in particular and has replaced silica sand in many of the non-ferrous foundries in the United States Spherical or ovoid grain, carbon or coke particles also have been used as foundry sands where silica sands and olivine sands do not have the physical properties entirely satisfactory for casting metals such as aluminum, copper, bronze, brass, iron and other metals and alloys. Such a carbon sand presently is sold by American Colloid Company of Arlington Heights, Ill. under the trademark CAST-RITE® and has been demonstrated to be superior to silica sand and olivine sand for foundry use.

The carbon sand used to date in the foundry industry, however, is relatively expensive to thermally stabilize so that the carbon foundry sand does not shrink or expand excessively when heated to the temperature of the molten metal that the sand is in contact with during casting. Expansion/contraction of a sand mold or core when heated to the elevated temperatures of molten metals may result in cracks in cores and molds and veining and metal penetration defects in the surfaces of the cast metal parts. Thus, the thermal stability of carbon sand is highly beneficial and is recognized as being superior to silica and olivine sands.

An inexpensive source for carbon particles useful as a carbon foundry sand is fluid coke that is a by-product of the petroleum refining industry. This petroleum refinery coke, or "raw fluid coke", is formed in a fluidized bed petroleum refining process and contains about 5% by weight petroleum hydrocarbons that volatilize into gases at the temperature of many molten metals, such as aluminum, copper, brass, bronze, and iron. During the casting of molten metals against raw fluid coke, evolving gases can bubble into the liquid metal and remain as cavities in the solidified casting, causing the casting to be scrapped.

To perform as a superior foundry sand, therefore, carbon sand should receive sufficient heat treatment to remove most of the volatile matter and to render it more thermally stable than both silica sand and olivine sand. Prior art carbon sands, therefore, have been devolatilized and pre-shrunk using an expensive, very high temperature heat treatment or calcining process at a temperature of about 2000° F. to 2800° F. A general description of the source and process of preparing and heat-treating the spherical or ovoid grain carbon sand is described in U.S. Pat. Nos. 2,830,342 and 2,830,913, which patents are hereby incorporated by reference.

In accordance with the present invention, it has been found that a spherical or ovoid raw fluid carbon or coke, e.g. petroleum-derived, as described in U.S. Pat. Nos. 2,830,342 and 2,830,913, having a suitable particle size for a foundry molding sand, can be roasted at a temperature of about 1000° F. to about 1500° F., particularly about 1200° F. to about 1400° F, e.g. 1300° F., to provide an unexpectedly superior spherical or ovoid carbon foundry sand that produces unexpectedly superior cast or molded metal parts. The roasted carbon foundry sand of the present invention is unexpectedly superior to carbon foundry sands that have been calcined at temperatures of 2000° F. and above, particularily for casting aluminum, brass and bronze.

SUMMARY OF THE INVENTION

In brief, the present invention is directed to a new and improved carbon sand and a method of treating a petroleum fluid carbon or coke, having a spherical or ovoid particle shape and a size suitable for a core or mold surface in the foundry industry, by heating or roasting the carbon particles at a temperature in the range of about 1000° F. to about 1500° F., particularly about 1200° F. to about 1400° F., for a time sufficient to volatilize from the carbon particles substantially all of the organic contaminants volatilizable at the roasting temperature, and a method of casting molten metal against the heat treated carbon particles, combined with a suitable binder, to form cast metal parts. The invention also includes the use of the carbon sand in forming molds and cores by all of the various processes and binder systems in common use, such as green sand and dry sand molding, shell mold process, binders cured by heat, gases, chemical catalysts and reactants and including the expendable pattern process.

Accordingly, one aspect of the present invention is to provide a new and improved carbon foundry sand that provides superior performance although thermally stabilized at a lower temperature than prior art carbon foundry sands.

Another aspect of the present invention is to provide a new and improved carbon foundry sand produced from spherical or ovoid carbon particles formed in a fluid coking process wherein oil is fractionated into lighter hydrocarbon components and spherical or ovoid coke particles that contain a small percentage (e.g., 0.2% to 10%) of volatile hydrocarbons, by heat-treating the contaminated coke particles at a temperature in the range of about 1000° F. to about 1500° F., in the absence of contact with additional petroleum hydrocarbons.

Another aspect of the present invention is to provide a spherical and/or ovoid mold and/or core sand by heat treating spherical and/or ovoid carbon particles at a temperature in the range of about 1200° F. to about 1400° F., wherein the carbon particles are formed by coking a petroleum oil to form hydrocarbon gases and solid spherical or ovoid coke particles that are deposited onto a fluidized bed of other coke particles.

Still another aspect of the present invention is to provide a new and improved carbon sand that is prepared by heat-treating carbon particles obtained from a petroleum fractionating process at a treating temperature in the range of about 1000° F. to about 1500° F., and thereafter coating the particles (spheroidal, ovoidal or ground to a desired particle size distribution) with a thin layer (e.g. 0.1$\mu$ to about 1 mm.) of a resin binder, such as a phenolic resin.

The above and other aspects and advantages of the present invention will become more apparent from the following detailed description of the preferred embodiments.

DETAILED DESCRIPTION OF THE PREFERRED EMBODIMENTS

The carbon sand of the present invention, with the exception of the heat-treating step can be obtained as a by-product from a fluidized bed petroleum fractionating process wherein a petroleum oil, particularly heavy oils, such as a heavy residual oil is heated to separate it into hydrocarbon vapor fractions and solid carbon or coke particles including a small percentage of heavy petroleum and sulfur contaminants. The resulting fluid coke particles form a fluidized bed in the fractionating apparatus that contact and heat the incoming oil. The resulting coke particles can be screened to provide an average particle size suitable for use as a molding sand, e.g., an American Foundry Society (AFS) average fineness number within the range of about 40 to about 200 and preferably at least about 50% of the particles have an AFS average fineness number of about 50 to about 100.

To date, the only carbon sands that have been used in the foundry industry have been calcined at a temperature of about 2000° F. and above. In accordance with the prior art, it was assumed that the higher the calcining temperature the better the product would perform in the casting use. In accordance with the present invention, it has been found that the coke particles from a fluidized bed petroleum fractionating or cracking process are more useful in the foundry industry for forming mold surfaces and mold cores, particularly in non-ferrous foundries, when heat treated at a temperature in the range of about 1000° F. to about 1500° F., particularly in the range of about 1200° F. to about 1400° F.

Any binder ordinarily used to bind silica, olivine and/or zircon, foundry sands, can be used with the carbon sands of the present invention to enable the sand to retain a predetermined or desired shape as a mold or core material. Such binders generally are present in amounts of about 1% to about 15% based on the total dry weight of the foundry sand mixture and may be adjusted to whatever amounts that will produce the desired strength, hardness or other physical properties. Some of the binders which can be used in the carbon sand of this invention include bentonites, clays, starches, sugars, cereals, core oils, sodium silicates, thermoplastic and thermosetting resins, vapor-curing binders, chemical-curing binders, heat-curing binders, pitches, resins, cements and various others known to the trade. Further, the carbon sands of the present invention can be used as the only foundry sand (100%), or the carbon sand can be used together with silica sand, olivine sand, zircon sand, calcined carbon sand, and the like in various percentages of carbon sand in an amount of about 5% to about 95% carbon sand based on the dry weight of the foundry sand used in the composition.

Some additives such as wood flour, cellulose, cereal flours, and iron oxide are sometimes used in common foundry sands for the purpose of overcoming sand expansion defects, particularly those defects occurring on flat casting surfaces, in an amount of about 0.5 to about 5% by weight of dry sand. Such additives can be reduced or eliminated with the foundry sand of the present invention due to the inherently low thermal expansion of carbon sand. The carbon sand of this invention may be coated with a suitable resin to produce a resin-coated carbon sand which is useful for the mold and core making process known to the trade as shell molding. Cements, e.g., portland; natural cements, such as heated, ground limestone; resins and the like in amounts of about 1% to about 10% by weight of the dry sand also can be added to carbon foundry sands of the present invention.

Various other additives may be included in the foundry sand of the present invention, such as various blackings or other carbonaceous materials, such as graphite; pitch; charcoal; bituminous coal, or soft coal, such as seacoal; hard coal; and other cokes which can be used with, or as a partial substitute for the carbon sand to prevent metal penetration or burn-on; chemical agents, such as resin binders; clay; oils, such as linseed oil and the like. These additional additives generally are included in amounts of less than about 1.0% to about 15% by dry weight of the sand.

Greater amounts of certain additives may be used when compounding molds and cores from the fluid coke of the present invention, while the amount of other types of additives normally used can be reduced or eliminated over that normally used with other sands. The percentage by dry weight of additives and binders needed with the foundry sand of this invention may be somewhat greater than that used with silica sands because of the greater volume per weight of fluid coke.

In accordance with another important embodiment of the present invention, the carbon sand of the present invention may be ground to a desired particle size distribution, or pulverized to form a carbon flour which can be used as a foundry sand or as an additive to other foundry sands to render such sand mixtures more thermally stable. In accordance with another embodiment of the present invention, the ground carbon-flour can be incorporated in an aqueous or solvent (e.g. denatured ethanol) slurry (2%–95% carbon flour) and used to coat the surfaces of cores and molds, and subsequently dried, to improve the surface finish of resulting castings.

Experiments were performed to determine whether a spherical and/or ovoid carbon sand for use in the foundry industry would be effective as a mold facing sand or mold core material when produced by "roasting" raw fluid coke at a temperature of about 1000° F. to about 1500° F., particularly at about 1200° F. to about 1400° F. The term "roasting" indicates relatively low temperature treatment as compared to the prior art calcining process, as described in U.S. Pat. Nos. 2,830,342 and 2,830,913 at about 2000° F. to about 2800° F.

The carbon sand was thermally stabilized by heating raw fluid coke to 1300° F. and holding the coke at that temperature until gas evolution ceased. The carbon sand then was tested in an aluminum foundry and in a bronze foundry by combining the carbon sand with a bentonite clay binder, and shaping the sand to form a mold cavity with the carbon sand-binder composition at the metal-receiving surface. The resulting castings were excellent. The carbon sand heat treated in accordance with the present invention produced castings of both aluminum and bronze which were entirely free of penetration, burn-on, or any other casting defects. Surface finish imparted by the carbon sand of the present invention was superior to that with silica and olivine sands, and, surprisingly, even better than the surface finish obtained with CAST-RITE ® 75 carbon sand that was heat treated or calcined at a temperature of about 2000° F.

Fluid coke roasted at a temperature within the range of about 1000° F. to about 1500° F., particularly about 1200° F. to about 1400° F., performs exceptionally well as a bentonite-bonded molding sand for aluminum and bronze; the cost of producing this roasted carbon sand of the present invention is only about half the cost of CAST-RITE ® 75; and the roasted carbon sand of the present invention is superior to and should cost less than olivine sand.

EXAMPLE 1

Preparation of Roasted Carbon Sand

One suitable raw fluid coke that can be heat treated in accordance with the present invention is raw fluid coke from the petroleum fluid coke process at the Esso/Imperial Oil Co. refinery, Sarnia, Ontario. However, any coke having a spherical or ovoid grain shape, such as that as produced from a petroleum refinery, and having a particle size suitable for the foundry industry, without grinding to destroy the spherical or ovoid shape, is suitable in accordance with the present invention. Oversize material can be removed by screening the fluid coke through a screen that is sized approximately equal to U.S. Sieve No. 20.

To produce the roasted carbon sand of the present invention, approximately one gallon of raw fluid coke was deposited in a 2-gallon steel pot (8" Dia.), and the pot was placed inside a reverberatory furnace, such as that commonly used for melting aluminum. The furnace is gas-fired, controlled by two thermocouples and loosely sealed from fresh air to prevent oxidation of the melt. The cold pot of fluid coke was shock heated for 30 minutes at approximately 1300° F. Upon removal from the furnace, the red hot fluid coke appeared to be boiling, indicating that volatile gases were still evolving from the coke. The "boiling" (which was fluidization by evolving gases) subsided and ceased as the coke cooled slightly. The hot coke was spread onto a steel plate to cool in open air. Indications were that very little coke was consumed by burning during this heat treatment.

EXAMPLES 2-5

Trial Of Roasted Carbon Sand as A Molding Sand for Aluminum Foundries

To evaluate in practice the roasted carbon sand prepared as described in Example 1, three other materials were also used for comparison purposes (1) Raw fluid coke (from Esso—Sarnia, Calif.), (2) Flexicoke, partially-gasified fluid coke (from Shell, Martinez, Calif.), and (3) CAST-RITE ® 75 Carbon Sand. Apparent densities of these materials were as follows: raw fluid coke—7.7 Lbs./Gal., Flexicoke—8 Lbs./Gal., CAST-RITE ® 75–9.5 Lbs./Gal., and Roasted Carbon Sand—9.13 Lbs./Gal.

Due to the differences in apparent densities of these materials and to other unexplained properties, identical molding mixtures would not produce useable green sand mold facings. Therefore, mixtures were concocted to have practical and nearly equal "feel", i.e., green strength and temper.

Accordingly, the following sand mixtures were prepared for foundry tests (in grams):

| Example | 2 | 3 | 4 | 5 |
|---|---|---|---|---|
| Raw fluid coke | 400 | | | |
| Roasted carbon sand (Example 1) | | 400 | | |
| Flexicoke | | | 400 | |
| CAST-RITE ® 75 | | | | 400 |
| Water | 40(10%) | 28(7%) | 56(14%) | 24(6%) |
| Southern (calcium) bentonite | 56(14%) | 56(14%) | 80(20%) | 44(11%) |

The mixture was prepared by mixing the carbon sand and water in a Hobart Kitchen Aid Mixer for 1 minute, followed by an additional 8 minutes of mixing after adding the bentonite.

Raw fluid coke absorbed more water than either the roasted carbon sand of Example 1 or CAST-RITE ® 75, even though removal of volatiles by calcining at 2000° F. has been shown to increase the measured porosity. The roasted carbon sand molding composition of Example 3 had excellent "feel", judged better than the molding sand compositions of Examples 2, 4 and 5.

The mixtures of Examples 2–5 were tested in practice at a commercial foundry by comparatively spot-facing molds with the compositions of Examples 2–5 for molding 8-Lb. aluminum pump adapter housings. The molds were finished off with a regular olivine molding sand. Aluminum alloy No. 319 was poured at approximately 1250° F.

Following shake-out, by visual inspection the casting faced with the molding sand of Example 3 was superior to all the others: peel was complete, casting finish was clearly better than production castings made with olivine 120 sand, and, unexpectedly, even better than CAST-RITE ® 75. The casting faced with Flexicoke (Example 4) was spotted with dark smudges not further identified or explained. The casting faced with raw fluid coke that was not thermally stabilized (Example 2) was deemed equal to olivine sand. However, the volatile gases which evolve from raw fluid coke at aluminum pouring temperatures would prevent its use in cores and would probably cause casting defects from molds for large aluminum castings and thin wall castings.

EXAMPLE 6

Preparation of Second Sample of Roasted Carbon Sand

Following the heat treatment of the first sample of roasted carbon sand (Example 1), gases were still evolving from the fluid coke after removing it from the furnace. To establish a better end point and manufacturing repeatability, a second sample of roasted carbon sand was prepared with continued heat treatment at 1300° F. until there was no further gas evolution. Accordingly, the same procedure was used, as in Example 1, to heat treat the fluid coke at 1300° F., but this time the heating continued for 1 hour. Upon removal of this material from the furnace, no "boiling" or other evidence of gas evolution could be detected by observation. Thus, this second sample of the roasted carbon sand of the present invention had reached an equilibrium for the heating temperature of 1300° F.

This roasted carbon sand heat treated for a time sufficient to remove substantially all materials volatile at 1300° F. weighed 9.25 Lbs./Gal. as compared to 9.13 Lbs./Gal. for the roasted carbon sand of Example 1.

EXAMPLE 7

Trial of Roasted Carbon Sand of Example 6 as A Molding Sand for Aluminum

To compare the roasted carbons sands of Examples 1 and 6, (heat treated ½ hour at 1300° F. and 1 hour at 1300° F., respectively) the following green sand molding mixtures were prepared:

| Test Mix No. | 1 | 2 |
|---|---|---|
| Roasted carbon sand of Example 1 (Grms.) | 400 | |
| Roasted carbon sand of Example 6 | | 400 |
| Water (Grms.) | 28 | 28 |
| Southern bentonite (Grms.) | 56 | 56 |

The carbon sand and water were mixed for 1 minute in a Hobart Kitchen Aid mixer followed by mixing an additional 5 minutes after addition of bentonite.

Neither test mix was optimum, since both were a little too stiff for easy ramming. A better mix for tightly rammed mold surfaces would be about 10% bentonite and about 4% water.

The above mixtures were tested at a commercial aluminum foundry by facing consecutive molds for 2½-Lb. terminal box castings. Molds were made on a jolt/squeeze rollover machine. The back-up sand was olivine 120 system sand. Aluminum alloy #319 was poured at 1400° F.

Upon inspection of the castings, it was clear that both carbon sands of Examples 1 and 6 produced better finish than the olivine system sand. The finish from both carbon sands of Examples 1 and 6 was excellent.

EXAMPLES 8–11

Test of Roasted Carbon Sand as A Molding Sand For Brass and Bronze Foundries Most non-ferrous foundries produce both aluminum and copper alloy castings. Brass and bronze are more difficult to cast than aluminum without penetration and veining casting defects and present a greater need for premium sands. Ideally, therefore, a roasted carbon sand should prove advantageous for brass and bronze castings also.

Accordingly, the roasted carbon sand of the present invention was tested in a commercial bronze foundry. This is a jobbing foundry producing a great variety of castings ranging in weight from a few ounces to several hundred pounds, many of which are high-leaded bronzes, the most difficult to cast without penetration defects.

For these Examples 8–11, the roasted carbon sand of Example 6 (roasted 1 hour at 1300° F.) was used, and for comparative purposes, CAST-RITE ® 75 Carbon Sand was tested also. The following green sand facing mixtures were prepared, using two moisture levels:

| Example No. | 8 | 9 | 10 | 11 |
|---|---|---|---|---|
| Roasted carbon sand (Grms.) | 400 | 400 | | |
| CAST-RITE ® 75 (Grms.) | | | 400 | 400 |
| Water (Grms.) | 16 | 20 | 16 | 20 |
| Southern bentonite (Grms.) | 40 | 40 | 40 | 40 |
| Moisture (determined) | 3.4% | 4.0% | 3.4% | 4.0% |

The carbon sand and water were mixed in a Hobart Kitchen Aid Mixer for 1 minute, followed by an additional 5 minutes of mixing after addition of bentonite.

The mixtures of Examples 8 and 10 felt quite dry but were moldable. The mixtures of Examples 9 and 11 felt stronger, less brittle, and better tempered. All mixtures had a velvety "feel", not sticky, with no differences between the two carbon sands. These mixtures were sealed in ZIPLOCK ® bags immediately after mixing and until tested in the foundry later the same day.

The castings made with the carbon sand mixtures of Examples 8–11 are called "guide bars", which are 36" long ×3" wide ×1" thick, cast three in a mold.

The sands were tested by facing 6" long sections of the drag side of the guide bar molds. Two molds were made, one for testing the 3.4% moisture mixtures and the other for the 4.0% moisture mixtures. Locations of the mixtures were identified with the ram-up letters. Upon stripping the molds, it was evident that the low moisture sand was too dry and although feasible, it was too brittle for easy molding. However, the mold surfaces formed with the low moisture sand were smooth and dense.

The test molds were poured with bronze having a composition of 80% copper, 10% tin and 10% lead (an alloy difficult to cast without defects). Pouring temperature was 2150° F. Upon shake-out, all of the carbon sand-faced sections peeled cleanly while the other castings were heavily coated with adhering sand. Following shot blasting, the following observations were made:

(a) The casting surfaces molded by the commercial foundry using silica sand bonded with 50% sodium bentonite/ 50% calcium bentonite were quite rough due to overall penetration and considerable burn-on in some areas.

(b) The surfaces molded in CAST-RITE ® 75 (Examples 10 and 11) were slightly rough due to very shallow over-all penetration.

(c) The surfaces molded in roasted carbon sand (Examples 8 and 9) showed absolutely no penetration or burn-on and finish was excellent, with lettering detail sharply defined. Clearly, the roasted carbon sand of the present invention was not only superior to silica sand, it was also superior to CAST-RITE ® 75.

(d) There was no discernible difference in performance between the 3.4% moisture and the 4.0% moisture carbon sand molding mixtures.

All who saw these castings marvelled at the good performance of the carbon sand molding compositions of Examples 8 and 9.

Many modifications can be made to the petroleum coking process used to form the fluid coke and other modifications made to known processes for molding or casting utilizing the carbon sands of the present invention.

I claim:

1. A carbon foundry sand for use in the foundry industry in forming a molded metal object comprising a plurality of coke particles formed by heating a petroleum oil to separate the oil into hydrocarbon vapors and spherical or ovoid coke particles, and thereafter heat treating the coke particles at a temperature in the range of about 1000° F. to about 1500° F., without substantial heating at a higher temperature, to volatilize hydrocarbons from the coke particles.

2. The carbon foundry sand of claim 1 further including a binder in an amount of about 1% to about 20% by total dry weight of the foundry sand and binder.

3. The carbon foundry sand of claim 1, wherein the sand is heat treated at a temperature of about 1200° F. to about 1400° F.

4. The carbon foundry sand of claim 3, wherein the sand is heat treated at a temperature of about 1300° F.

5. The carbon foundry sand of claim 2 wherein the binder is bentonite clay in an amount of about 10% to about 15% by total dry weight of sand and binder.

6. The carbon foundry sand of claim 1, wherein the coke particles are formed in a fluidized bed oil refining process prior to heat treating, and the particles are separated from the oil being refined prior to the heat treatment.

7. The carbon foundry sand of claim 1 wherein the spherical or ovoid particles are ground to a desired particle size distribution.

8. The carbon foundry sand of claim 1 wherein the carbon particles are coated with a resin binder.

9. The carbon foundry sand of claim 1 further including about 5% to about 95% silica sand by total dry weight of carbon sand and silica sand.

10. The carbon foundry sand of claim 1 further including about 5% to about 95% olivine sand by total dry weight of carbon sand and olivine sand.

11. The carbon foundry sand of claim 1 further including about 5% to about 95% zircon sand by total dry weight of carbon sand and zircon sand.

12. A method of manufacturing a cast metal part including forming a foundry sand mixture comprising carbon foundry sand and a binder, shaping the foundry sand mixture into a shape having at least one surface with a desired configuration and thereafter pouring molten metal in contact with said shaped surface of the foundry sand to solidify while in contact with said shaped surface of the foundry sand, said carbon foundry sand comprising a plurality of coke particles formed by heating a petroleum oil to separate the oil into hydrocarbon vapors and spherical or ovoid coke particles, and thereafter heat treating the coke particles at a temperature in the range of about 1000° F. to about 1500° F., without substantial heating at a higher temperature, to volatilize hydrocarbons from the coke particles.

13. The method of claim 12, wherein the fluid carbon sand is heat treated at a temperature of about 1200° F. to about 1400° F.

14. The method of claim 12, wherein the molten metal is aluminum.

15. The method of claim 12, wherein the molten metal is brass.

16. The method of claim 12, wherein the molten metal is bronze.

17. The method of claim 12, wherein the molten metal is copper.

18. The method of claim 12, wherein the molten metal is iron.

19. The method of claim 12, wherein the foundry sand mixture further includes an additive selected from the group consisting of coal, seacoal, seacoal substitutes, carbonaceous materials, cellulose, cereal, and fibrous additives in an amount of about 0.5 to about 20% based on the dry weight of the foundry sand.

20. The method of claim 12 wherein the foundry sand mixture includes a binder coating selected from the group consisting of clay, starch, resin, drying oil, sodium silicate, pitch and cement, in an amount of about 0.5 to 20% based on the dry weight of the foundry sand.

21. The method of claim 12 wherein the foundry sand mixture includes a curing agent capable of curing the binder.

22. A method of providing a carbon sand surface onto a mold or core comprising coating the surface of the mold or core with a slurry containing about 5% to about 95% carbon foundry sand and thereafter drying the slurry coating, said carbon foundry sand formed by heating a petroleum oil to separate the oil into hydrocarbon vapors and spherical or ovoid coke particles, and thereafter heat treating the coke particles at a temperature in the range of about 1000° F. to about 1500° F., without substantial heating at a higher temperature, to volatilize hydrocarbons from the coke particles.

* * * * *